United States Patent [19]

Yokomatsu

[11] Patent Number: 4,725,262

[45] Date of Patent: Feb. 16, 1988

[54] PROCESS AND APPARATUS FOR THE MANUFACTURE OF A VALVED SACK WITH SELF-SEALING VALVE

[76] Inventor: Masayoshi Yokomatsu, 25-11-25, Fukawa, Tone-machi, Kita-Soma-Gun, Ibaragi Prefecture, Japan

[21] Appl. No.: 901,997

[22] Filed: Aug. 28, 1986

Related U.S. Application Data

[63] Continuation of Ser. No. 527,469, filed as PCT EP 82/00277, Dec. 29, 1982, published as WO 83/02252, Jul. 7, 1983, abandoned.

[30] Foreign Application Priority Data

Dec. 29, 1981 [JP] Japan ..... 56-214.294

[51] Int. Cl.[4] ..... B31B 1/84

[52] U.S. Cl. ..... 493/213; 493/279; 493/929

[58] Field of Search ..... 493/213, 223, 224, 432, 493/929, 279

[56] References Cited

U.S. PATENT DOCUMENTS

| | | | |
|---|---|---|---|
| 2,460,885 | 2/1949 | Hoppe | 493/213 |
| 2,668,481 | 2/1954 | Robinson | 493/213 |
| 2,708,392 | 5/1955 | Orr | 493/213 |
| 2,762,272 | 9/1956 | Taylor et al. | 493/289 |
| 2,775,171 | 12/1956 | Steen et al. | 493/226 |
| 2,791,160 | 5/1957 | Burrell | 493/213 |
| 2,891,791 | 6/1959 | Chase | 493/432 |
| 2,895,387 | 7/1959 | Robinson et al. | 493/223 |
| 2,955,517 | 10/1960 | Honsel | 493/213 |
| 3,472,130 | 10/1969 | Brockmuller | 493/213 |
| 3,479,802 | 11/1969 | Fesco | 493/213 |
| 3,548,722 | 12/1970 | Jones | 493/213 |
| 3,551,238 | 12/1970 | Rochla | 156/201 |
| 3,657,975 | 4/1972 | Feldkamper et al. | 493/213 |
| 3,853,040 | 12/1974 | Achelpohl | 493/213 |

FOREIGN PATENT DOCUMENTS

| | | | |
|---|---|---|---|
| 878245 | 8/1971 | Canada | 493/213 |
| 720452 | 5/1942 | Fed. Rep. of Germany . | |
| 855943 | 11/1952 | Fed. Rep. of Germany | 493/213 |
| 1128731 | 4/1962 | Fed. Rep. of Germany . | |
| 1103604 | 5/1955 | France . | |
| 1465224 | 11/1966 | France . | |
| 1487788 | 5/1967 | France . | |
| 1512942 | 1/1968 | France . | |
| 2042816 | 2/1971 | France . | |

*Primary Examiner*—Frederick R. Schmidt
*Assistant Examiner*—William E. Terrell
*Attorney, Agent, or Firm*—Wegner & Bretschneider

[57] ABSTRACT

Process and apparatus for the manufacture of a valved sack with a self-sealing valve in which at the end of a transporting device for an open web of the sack material, shortly before the sack material is fed into a tube-forming zone, a valve-manufacturing unit is located, preferably above the material web path, in which unit valves are produced from a stock reel of paper and fed in a positioned manner to the open sack web, which has been pre-glued into fine zones. The pre-fabricated paper valves are then brought in contact with the pre-glued open sack web and the valve sleeve is securely glued into the sack in a gluing zone within the apparatus.

5 Claims, 7 Drawing Figures

PROCESS AND APPARATUS FOR THE MANUFACTURE OF A VALVED SACK WITH SELF-SEALING VALVE

Ser. No. 527,469, filed as PCT EP82/00277, Dec. 29, 1982, published as WO83/02252, Jul. 7, 1983, now abandoned.

FIELD OF THE INVENTION

The invention relates to a process and an apparatus for the manufacture of a single-ply or multi-ply valved sack, of paper or film, having a self-sealing valve.

BACKGROUND OF THE INVENTION

Valved paper sacks are used extensively for packaging pulverulent or granular material. The scatterable or pourable material can be introduced on automatic filling equipment, and the valve, which self-seals, after filling, through the pressure exerted by the contents, in most cases makes an additional process step for sealing the filled sack unnecessary; alternatively, additionally applied sealing sheets are subjected to substantially less stress because of the self-sealing properties of the valve.

In addition to the extensively employed stitched valved sack, the block-bottom valved sack is very important. Whilst the stitched sack on the one hand has the advantage that it is inexpensive to manufacture, it also reveals the disadvantage of not being absolutely tight. On the other hand, a block-bottom valved sack exhibits good tightness but against this is more expensive, and requires more material, in its manufacture.

European Patent Application No. 82/108,232.8 has proposed a gusseted valved sack in which the valve is introduced into the lengthwise weld of the piece of tubing, in the vicinity of one of the two folded bottoms of the sack. This gusseted valved sack is less expensive to manufacture than a block-bottom valved sack; moreover, it is even superior to the latter in tightness.

SUMMARY OF THE INVENTION

It is an object of the present invention to provide, as far as possible using conventional sack machinery, a process and an apparatus with which such proposed gusseted valved sacks with a valve inserted into the lengthwise weld of the sack tubing can be manufactured inexpensively.

The process according to the invention, and the apparatus employing this process, are distinguished in that at the end of a transporting device for an open web of the sack material, shortly before the latter is led into a tube-forming zone, a valve-manufacturing unit is located, preferably above the material web path, in which unit valves are produced from a stock reel of paper and fed in a positioned manner to the open sack web, which has been pre-glued in defined zones. The prefabricated paper valves are brought into contact with the pre-glued open sack web and after the valve has been applied the sack web carrying the valve passes through a pressure zone in which secure gluing of the valve sleeve supplied is achieved.

BRIEF DESCRIPTION OF THE DRAWINGS

The invention and the advantageous details are explained further below in relation to an example, with reference to the drawings. In the drawings.

DETAILED DESCRIPTION OF THE INVENTION

Figure 1:
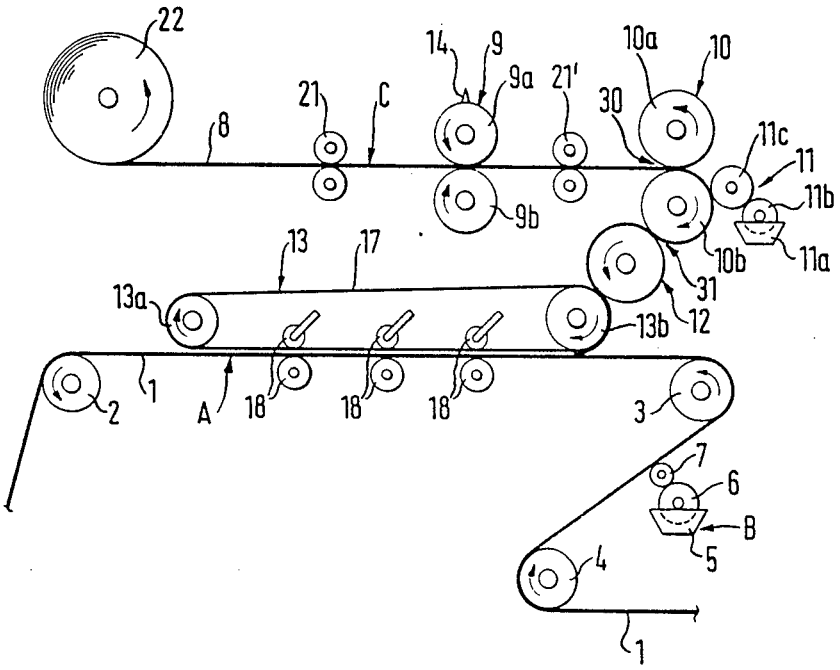
FIG. 1 shows a schematic representation of a transport device for a sack web with a device, arranged above it, for the manufacture of a valve sleeve.

FIG. 1 shows a portion of a sketch illustrating the principle of a sack machine to which a valve-manufacturing unit has been added. A sack web 1, which in the case of a single-ply sack can be described as an open sack web, whilst in the case of a multi-ply sack it represents the inner sack web, is first guided over a roll 4 and pre-glued in a gluing station B in the area where the valve is subsequently applied. The gluing station B consists essentially of a glue trough 5, a pick-up roll 6 and an applicator roll 7 adapted to apply the glue in the appropriate format. A guide roll 3 again changes the direction of the open sack web 1. A valve or valve sleeve 24 is applied by means of the roller **13*b* of a valve-manufacturing apparatus, to be described in more detail below, and on passage through a pair of pressure rollers, 18, the sack web and the valve sleeve applied to it are pressed together to ensure intimate gluing. The open sack web accordingly carries the applied valve when reaching a guide roll 2** at the exit point of the intermediate product or at the transfer to a sack-manufacturing machine.

To assist pressing the components together, a conveyor belt 17 circulates in the area of a pressure station 13, and a cylinder **13*b*, which at the same time applies the valve sleeve 24 to the open sack web 1, serves, on the side away from a cylinder 13*a*, as a guide roll for one or more conveyor belts 17**.

The valve former and applicator to be described below comprises the following sub-units:

A roll 22 represents the material stock roll for a valve web 8, from which the valve sleeves 24 are produced in a manner described in more detail below. 21 indicates a traction unit which ensures that the valve web 8 is transported in the required format. In a cross-cutter 9 with cutting blade 14, mounted on an upper roll **9*a*, with a lower roll 9*b* serving as counter-pressure roll, downstream of point C, portions in the length required for the manufacture of the valves are severed from the valve web 8. A traction group 21' serves to ensure the further transport of the successively produced valve sheets 24', and the groups of rolls 10, 11, 12 successively produce a first creasing, a zonal gluing, a second creasing and a folding-over of the valve sheets 24' to form a valve 24 in the form of the numeral "9", and finally, the transfer of the finished valve sleeve 24 to the transfer cylinder 13*b*** already mentioned.

Figure 2:
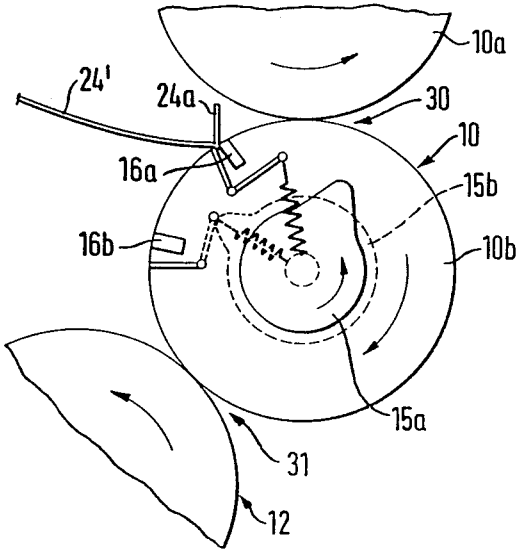
Figure 5:
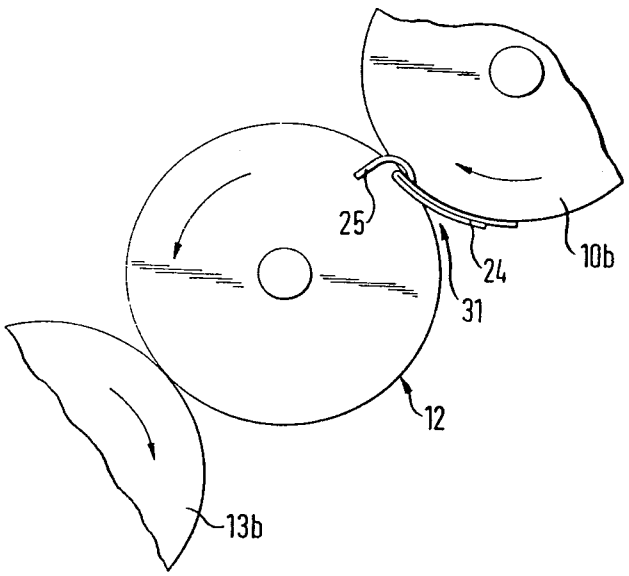

FIGS. 2, 3, 4 and 5 show in detail the creasing and gluing processes which occur in the zone of the stations 10 to 12:

FIG. 2 first of all illustrates the process step on an individualized valve sheet 24', when the latter reaches to creasing assembly 10. The lower creasing cylinder **10*b* carries two creasing flaps 16*a* and 16*b*, which are controlled by cams 15*a*, 15*b*. FIG. 2 shows furthermore that the individualized valve sheet 24' has been seized by the front creasing flap 16*a* of the creasing cylinder 10*b* just behind the leading paper edge, so that a front tab 24*a* of the valve sheet 24'** has been bent up.

Figure 3:
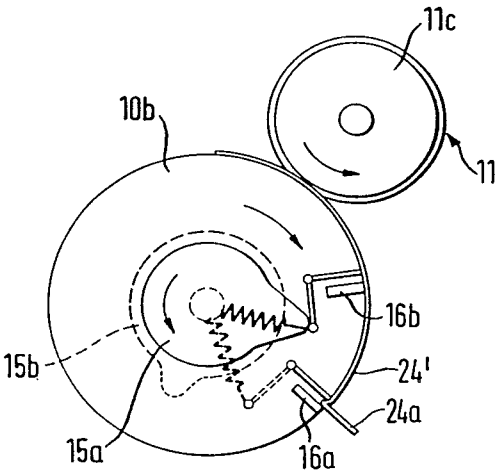
FIGS. 2 to 6 represent the principle of partzones of the device for the manufacture of the valve sleeve and FIG. 7 serves to illustrate the individual process steps in the manufacture of a valve sleeve.
Figure 4:
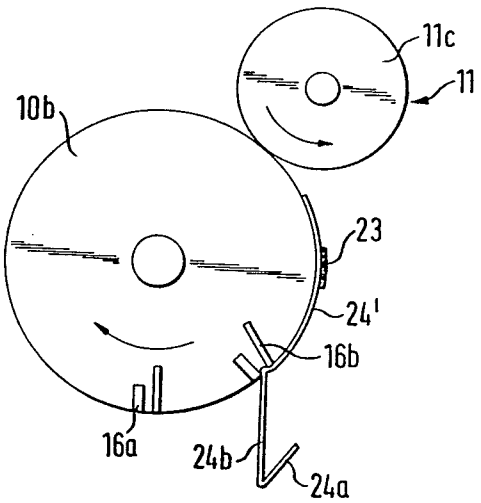

FIG. 3 shows the next step: the creasing flap **16*a* continues to hold the valve sheet 24' with the front tab 24*a* firmly, and the open valve sheet 24' is glued zonally by the glue applicator roll 11c of the gluing station 11, so that, as FIG. 4 shows, the glue trace 23 is applied to the open valve sheet 24'. In FIGS. 3 and 4, the gluing unit 11 is simply represented by the glue applicator roll 11c. However, FIG. 1 shows that the gluing unit 11 additionally has a gluing trough 11a and a pick-up roll 11b**.

FIG. 4 shows that as the creasing cylinder 10b continues to rotate, the creasing flap 16a has now also opened whilst the creasing flap 16b has now seized the as yet open valve sheet 24' resulting, because of the intrinsic stiffness of the paper, in a tab 24b being turned up, which tab in turn carries, angled in the opposite direction, the backward-pointing tab 24a. When the as yet open valve sheet 24' passes through the roll nip 31 between the creasing cylinder 10b and a gripper drum 12, the advancing tab 24b is now folded over completely, so that the tab 24a comes to rest on the glue trace 23. This completes the folding of the valve which, though it is still lying flat, is in principle already in the shape of a numeral 9.

Figure 6:
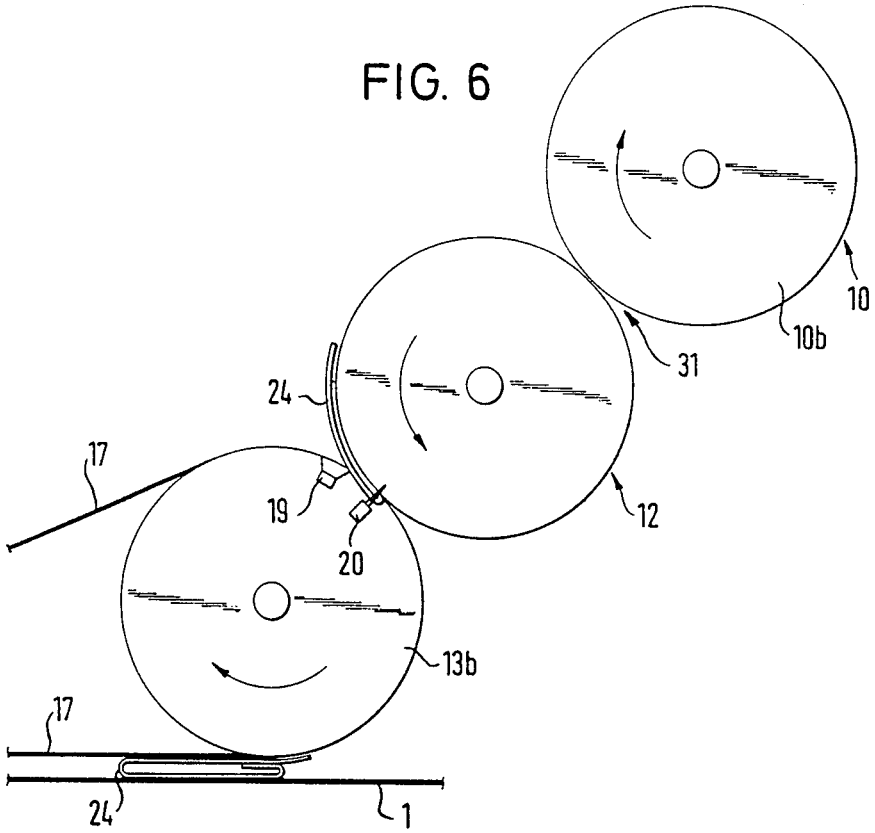

The gripper drum 12 now seizes, by means of the gripper 25, the valve sheet 24' on the creasing drum 10b and finally, at the contact point of the rolls 12 and 13b, the finished valve sleeve 24 is transferred from the gripper drum 12 to the transfer cylinder 13b, as shown in FIG. 6. To effect this transfer, a gripper finger 25 (not shown in more detail) must open at this transfer point; at the same time the valve sleeve 24, lying flat, is lightly seized by a fine needle 20 attached to the transfer cylinder 13b and the actual transfer of the finished folded valve sleeve 24 to the transfer cylinder 13b is ensured by a suction pad 19 connected to an intermittently acting vacuum pump, not shown in more detail. At the lower point of the transfer cylinder 13b the vacuum of the suction pad 19 is switched off so that, assisted by the belt or belts 17, the transfer of the valve sleeve 24 from the transfer cylinder 13b onto the previously described sack web, preglued zonally by the gluing unit 5, 6, 7, may take place.

Preferably, the upper creasing cylinder 10a has two creasing blades, not shown in more detail, which, when the open valve sheet 8 passes through the roll nip 30 between the two creasing cylinders 10a and 10b, ensure that the valve sheet 8 is seized by the two creasing flaps 16a and 16b in the lower creasing cylinder 10b. For this, a cycle control system must be provided so that the creasing flaps 16a and 16b each are open before passing into the roll nip 30 between the creasing cylinders 10a and 10b, so that the creasing blades of the upper creasing cylinder 10a can lightly enter the gaps created by the open creasing flaps 16a, 16b and thereby press the paper into these open creasing flaps. In this way the open valve sheet 8, after passing through the nip 30 between the upper creasing cylinder 10a and the lower creasing cylinder 10b, is already seized by both the creasing pincers even before the open valve sheet 8 passes the gluing station 11. However, with such a creasing flap control system it may happen that after the creasing flap 16a has opened the larger tab 24b will not adequately stand up, which however would be advantageous for complete folding-over of the tab 24b at the point of passage 31 between the cylinders 10b and 12. Advantageously, therefore, the valve-manufacturing unit can also be equipped with two creasing blade cylinders so that the creasing cylinder 10a has only one creasing blade, with which secure gripping of the valve sheet 8 by the creasing flap 16a can be ensured. The severed valve sheet 24', which in this way is only gripped at one place by one creasing pincer then passes through the gluing station 11 before a second creasing cylinder, not shown in more detail, ensures the gripping of the valve sheet 24' by the creasing pincer 16b. For secure turning-up of the valve tab 24b it is then advantageous to open the front creasing flap 16a already during, or immediately after, the gripping of the valve sheet 24' by the creasing flap 16b. The nip 31 between the two cylinders 10b and 12 serves both to fold over the tab 24b and to ensure gripping of the valve, finished by this folding-over, by means of the gripper finger 25, which can also be constructed as a gripping pincer.

Figure 7:
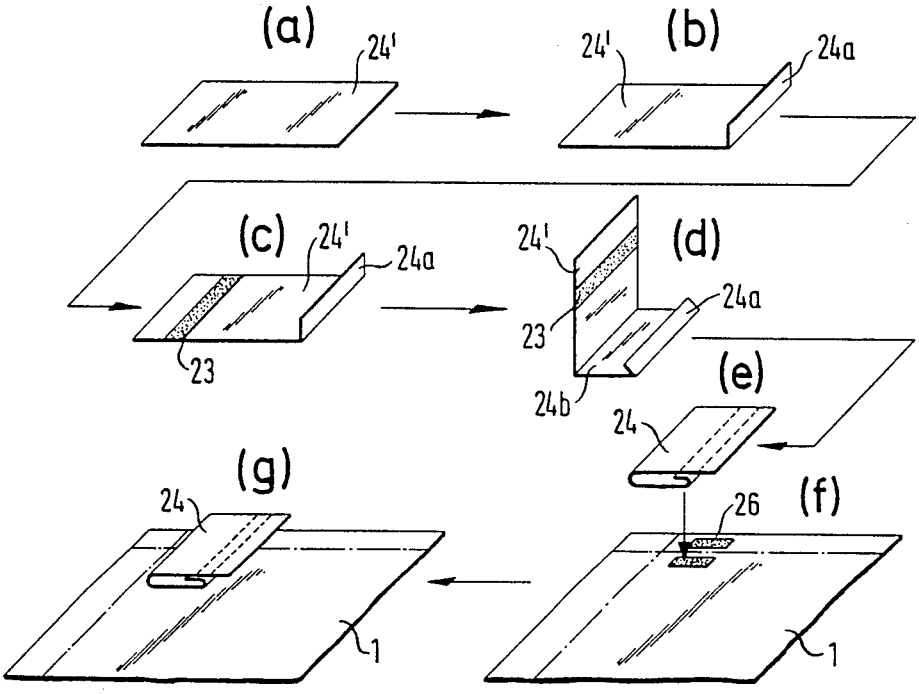

Finally, FIG. 7 once again explains, through perspective separate illustrations, the individual process steps in the manufacture of the 9-shaped valve. FIG. 7a shows the as yet uncreased valve sheet 24', after already having been severed from the valve web 8, ie. the sheet in the form in which it passes, for example, the zone of the traction station 21'. FIG. 7b illustrates the valve sheet 24' after the first creasing in the creasing flap 16a of the creasing cylinder 10b, resulting in formation of the front tab 24a. FIG. 7c shows the valve sheet 24', pre creased once, with a front flap 24a, after passing through the gluing station 11 which applies the glue trace 23. FIG. 7d finally shows the valve sheet 24' after the second creasing in the creasing flap 16b, so that the valve sheet 24' having a large tab 24b and a small tab 24a is clearly discernible. Finally, the valve 24, shown finished in FIG. 7e, is applied on the sack web 1, provided with the glue traces 26, shown in FIG. 7f, and FIG. 7g further shows the open sack web 1 with the valve 24 applied to it, in the manner in which the combination of sack web 1 and valve 24 appears after passing through the pair of pressure rollers 18.

In order to permit simple adaptation of the valve manufacturing process to different sack sizes, a cycle control system can be provided for the valve manufacturing unit so that, for example, the onward transport of the severed valve sheets 24' by the traction group 21' is synchronized with the variable sack size.

The process according to the invention for the manufacture of paper or film sacks with a self-sealing valve, and the apparatus according to the invention, suitable for this process, are in particular distinguished by the fact that, employing a substantially fully automatic process, inexpensive self-sealing valved sacks for pulverulent or granular material can be manfactured and different sack sizes can be taken into account.

We claim:

1. In a process for making valved paper sacks from an open paper web within a sack-making machine, a process for pre-forming a paper valve sleeve and attaching the valve sleeve to a ply of the open web comprising the steps of:

(a) applying glue to the portion of the ply where the valve sleeve is to be attached;

(b) pre-forming the valve sleeve within a selfcontained valve manufacturing unit located adjacent the ply, by supplying a web of valve paper, cross-cutting the valve paper web to form a valve sheet, transversely folding and gluing the valve sheet to form the sheet into a valve sleeve having the shape of a numeral 9;

(c) superimposing the thus-formed valve sleeve on said portion of the ply; and (d) applying pressure to said valve sleeve and said ply, thereby ensuring complete attachment of said valve sleeve to said ply.

2. A process as claimed in claim 1, further comprising adjusting the valve-manufacturing unit to give a different cycle time for feeding the valve sleeves to the gluing station.

3. An apparatus for the manufacture of a valved sack of paper having a self-sealing valve comprising:

(a) a transporting means for transporting an open sack web along a path;

(b) a first gluing means along the web path for gluing the sack web passing the gluing means in predetermined areas; and (c) a manufacturing means along the web path and synchronized with the cycle of the transporting means for manufacturing a paper valve sleeve to be glued into the sack, said manufacturing means comprising the following sub-units:

(1) a cross-cutting pair of cylinders with cutting blades which cut a paper valve web into valve sheets of predetermined length;

(2) a group of creasing cylinders positioned after downstream of the cross-cutting pair of cylinders which seize and crease the individual valve sheets produced by the cross-cutting pair of cylinders;

(3) a gluing station positioned downstream of the creasing cylinders having means for gluing the creased valve sheets in defined areas; and (4) a gripper drum positioned downstream of the gluing station which, in cooperation with one of the creasing cylinders, folds the valve sheet to form a valve sleeve in the shape of a numeral 9 and applies the valve sleeve to the pre-glued areas of the sack web.

4. An apparatus as claimed in claim 3, wherein one of the creasing cylinders comprises creasing flaps which are opened and closed via a cam control and cooperate a creasing counter-cylinder provided with two corresponding creasing blades.

5. An apparatus as claimed in claim 4 or 3, wherein the gripper drum and one of the creasing cylinders cooperate to fold the valve sheet and press a valve tab of the valve sleeve onto the defined areas of the valve sheet, thereby to form the valve sleeve, and wherein the manufacturing means further comprises a pressure station having pressure rolls to press the thus-formed valve sleeve onto the sack web.

* * * * *